United States Patent [19]

Cord et al.

[11] 4,356,768

[45] Nov. 2, 1982

[54] DELAY FUSE WITH A SLOW RATE OF COMBUSTION AND A SMALL DIAMETER

[75] Inventors: Paul P. Cord, Saint Aubin de Medoc; Louis R. Guy, Paris, both of France

[73] Assignee: Societe Nationale des Poudres et Explosifs, Paris, France

[21] Appl. No.: 179,973

[22] Filed: Aug. 21, 1980

[30] Foreign Application Priority Data

Sep. 6, 1979 [FR] France ..... 79 22278

[51] Int. Cl.[3] ..... C06C 7/00

[52] U.S. Cl. ..... 102/275.9; 102/202.13; 149/42; 149/77

[58] Field of Search ..... 102/202.13, 275.3, 275.9; 149/42, 77

[56] References Cited

U.S. PATENT DOCUMENTS

| | | | |
|---|---|---|---|
| 3,173,367 | 3/1965 | Shinpaugh | 102/202.13 X |
| 3,528,864 | 9/1970 | Weinland | 149/107 X |
| 3,664,898 | 5/1972 | Taylor et al. | 149/42 X |
| 3,684,594 | 8/1972 | Evans | 149/42 X |
| 3,901,747 | 8/1975 | Garner | 149/77 X |
| 4,144,814 | 3/1979 | Day et al. | 102/202.13 |

*Primary Examiner*—Peter A. Nelson

*Attorney, Agent, or Firm*—Bucknam and Archer

[57] ABSTRACT

The invention relates to a delay fuse having a rate of combustion which is less than or equal to 4 mm/second, characterized in that it has a diameter which is less than or equal to 3 mm and in that it contains a pyrotechnic composition consisting of 25 to 45% by weight of tungsten having a particle size of between 2 and 4 microns, from 45 to 65% by weight of barium chromate and from 8 to 15% by weight of potassium perchlorate.

The delay fuse according to the invention, which is provided with a metal sheath, is applied, in particular, in the pyrotechnic systems carried on board space missiles or submarines.

6 Claims, No Drawings

DELAY FUSE WITH A SLOW RATE OF COMBUSTION AND A SMALL DIAMETER

The invention relates to delay fuses, that is to say to fuses containing a pyrotechnic composition with a relatively slow rate of combustion, the said composition being confined in a sheath which is generally made of metal.

The ignition of a delay fuse of this type, which may be caused by a pyrotechnic signal flare, makes it possible to induce, in a pyrotechnic sequence in which it is present, a slowing-down or a considerable delay in the progression of a pyrotechnic signal flare.

Numerous pyrotechnic compositions are known which are capable of burning at a relatively slow rate of the order of a few centimeters to a few tens of centimeters per second.

In general, these compositions mainly comprise a combination of a reducing agent, such as boron, magnesium, aluminium, silicon, titanium, manganese, chromium, zirconium, niobium, molybdenum, tungsten or thorium, with a transition metal oxide or with one or more oxygen-containing oxidising salts of alkali metals or of alkaline earth metals, such as the chlorates, perchlorates, nitrates, oxides, peroxides, chromates and dichromates of these metals. A considerable proportion of these compositions can consist of inert materials, the purpose of which is to reduce the quickness of the composition.

Compositions of this type, which are very widely used in delay relays, are defined by the U.S. Military Standard Specifications MIL-T-23132 of 21st December 1961 and 23123A of 16th June 1972. For example, they are employed in U.S. Pat. No. 4,144,814 and consist of mixtures containing from 30 to 60% by weight of tungsten having a particle size of between less than 1 micron and 10 microns, from 30 to 60% by weight of barium chromate, from 5 to 9% by weight of potassium perchlorate and about 5% of silica in the form of diatomaceous earth.

However, delay relays are relatively large metal components because the delay column, that is to say the part which contains the pyrotechnic composition, has a diameter of at least 5 mm, whilst the external diameter of these devices is at least 8 mm.

Taking into account that these delay relays had an attractive rate of combustion of the order of 1 to 5 mm/second, attempts were made to employ the compositions of the said Standard Specification MIL-T-23132 in even smaller devices, by reducing the diameter of the delay columns.

The results of these endeavours are reported in the article by S. G. NESBITT, entitled "A study of fast burning tungsten delay compositions in small column diameters", delivered at the 4th Symposium on Pyrotechnics, held from 22nd to 26th July 1974 in DENVER, COLORADO. This author observed that, for compositions belonging to Series I of the said Standard Specification, that is to say for the fastest-burning compositions, in relative terms, having a rate of combustion of several tens of millimeters per second, the propagation of the combustion is generally still good in metal tubes with an external diameter of 12 mm and an internal diameter of only 1 mm. However, this author notes that the slowest-burning of the compositions which he tested, burning at a rate of 9.4 mm/second, gives a 60% failure rate with this column diameter of only 1 mm.

Now, it is well known that, in the context or relays, a reduction in the thickness of the metal walls causes a greater concentration of the heat in the region of the pyrotechnic composition and hence an acceleration of the rate of combustion of the latter. The standard work by H. ELLERN, entitled "Military and Civilian Pyrotechnics", Chemical Publishing Company, 1968, can be consulted on this subject.

The final result of the above study is that, at the present time, for those skilled in the art, a delay fuse having an internal diameter of 1 mm can only have a rate of combustion above about 10 mm/second for an external diameter of at least 12 mm, because any reduction in the thickness of the metal wall of the fuse can only increase the rate of combustion of the latter.

It is understood that fuses of this type cannot be used for long delays because of their high rate of combustion and because of their weight in systems carried on board space missiles or submarines. The only possibility of reducing this weight, whilst retaining the known compositions, therefore seems to be the use of a larger internal diameter, of the order of 3 to 5 mm, and a lower wall thickness; however, this solution, which leads to satisfactory performances from the point of view of the reliability and the rates of combustion (slower-burning compositions can be adopted and this offsets the acceleration due to the reduction in the wall thickness), proves incompatible, on the other hand, from the point of view of the weight carried, because the resulting weight decrease is more than offset by the weight of the additional heat protection to be provided; in fact, a doubling of the internal diameter of the fuse causes a fourfold increase in the amount of heat released by the pyrotechnic composition.

Under these conditions, it seems impossible to produce a delay fuse which has, at one and the same time, a good reliability, a small internal and external diameter and a low rate of combustion.

The invention relates to a delay fuse having a rate of combustion which is less than or equal to 4 mm/second, characterised in that it has a diameter which is less than or equal to 3 mm and in that it contains a pyrotechnic composition consisting of 25 to 45% by weight of tungsten having a particle size of between 2 and 6 microns, preferably between 2 and 4 microns, from 45 to 65% by weight of an alkali metal chromate or dichromate or alkaline earth metal chromate or dichromate, and from 8 to 15% by weight of an alkali metal perchlorate or alkaline earth metal perchlorate.

According to a first embodiment of the invention, an alkali metal chromate or alkaline earth metal chromate is used in preference to an alkali metal dichromate or alkaline earth metal dichromate, and an alkaline earth metal chromate is used in preference to an alkali metal chromate. Barium chromate is particularly preferred. Mixtures of different chromates or dichromates can be used.

According to a second embodiment of the invention, an alkali metal perchlorate is used in preference to an alkaline earth metal perchlorate. Sodium perchlorate and, above all, potassium perchlorate are particularly preferred. Ammonium perchlorate is less advantageous because its use leads to an increase in the rate of combustion of the composition. Mixtures of different perchlorates can be used.

According to a third embodiment of the invention, tungsten having a particle size of between 2 and 4 microns is used. In fact, if a particle size of more than 4 microns and less than 6 microns is used, defects in the ignition of the composition are likely to occur, in particular if the latter contains less than 35% by weight of tungsten. The tungsten cannot be totally replaced by any other metal.

According to a particularly preferred embodiment of the invention, the composition for filling the delay fuse only comprises from 28 to 35% by weight of tungsten having a particle size of between 2 an 4 microns, from 55 to 62% by weight of barium chromate and from 9 to 12% by weight of potassium chlorate. The incorporation of silica is incompatible with the compositions used within the scope of the invention.

The external envelope of the delay fuses according to the invention is made, in a conventional manner, from a metal or a metal alloy which is preferably ductile and has a low melting point. Lead and leadbased alloys, in particular those based on tin and/or antimony, are suitable. However, it is also possible to use a woven sheath or an extruded synthetic material, but this is of little value in practice.

The delay fuses according to the invention can be manufactured in a usual manner which is in itself known. For example, they can be obtained from a fuse made of ductile metal, which has a relatively large diameter (10–25 mm) and contains the composition indicated above, by passing the said fuse through dies of decreasing diameters. The delay induced by the fuse can be precisely adjusted by measuring the rate of combustion of a fragment of the latter when it leaves the die. It is also possible to obtain the fuses according to the invention by progressively reducing the diameter by means of a series of passes through the various grooves, of decreasing cross-sections, in a rolling machine, or by means of a series of passes through a rolling machine, followed by a series of passes through dies. The conventionally used cross-section reduction ratio of the order 0.9 for each pass is suitable.

The delay fuses according to the invention have an external diameter of between 1.5 and 3 mm and a ratio of the external diameter of the delay fuse to the diameter of the core occupied by the pyrotechnic composition of between 1.4 and 2.0. The real density of the compositions which they contain is, in practice, very much less than the theoretical values and is between 2.7 and 4.0 g/cm$^3$, preferably between 3.0 and 3.4 g/cm$^3$.

The delay fuses according to the invention moreover show an excellent stability to heat because their self-ignition temperature is commonly above 500° C. Furthermore, their exceptionally low rate of combustion, taking into account their small diameter, only varies very slightly as a function of the temperature; a variation of only 10% is commonly observed between −60° C. and +75° C., and this is considered as remarkable.

The result of all the abovementioned advantages, together with the fact that the combustion of the compositions according to the invention is accompanied by a zero or negligible release of gas, is that the delay fuses according to the invention make it possible to ensure, with an excellent reliability and over a wide range of conditions, delays of a few tens of seconds to several minutes and even several hours, whilst at the same time occupying a very small volume and releasing only a small amount of heat of combustion, and this finally has the effect of considerably reducing the weight of the heat protection surrounding the said delay fuses in the pyrotechnic systems carried on board space missiles or submarines. In order fully to appreciate the value of the delay fuses according to the invention, it will be noted that the simple fact of being able to reduce the diameter of a delay fuse by half makes it possible to reduce the amount of heat of combustion which it releases by a factor of 4, for the same rate of combustion. It is thus possible to produce reels with contiguous turns without the risk of premature ignition from one turn to the next.

The delay fuses according to the invention are illustrated by the following non-limiting examples:

EXAMPLE 1

A tube made of lead containing 5% of antimony, and having an external diameter of 17 mm and an internal diameter of 12 mm, was filled with a composition consisting of 32% by weight of tungsten having a particle size of 2 microns, 58% by weight of barium chromate and 10% of potassium perchlorate.

In order to achieve uniform filling, the tube is filled with successive small amounts of a few cm$^3$ and, after each introduction, the composition is tamped, using a piston, by applying a pressure of about 16 bars.

The tube, blocked at each end by a lead plug, is then converted into a fuse with an external diameter of 2 mm by means of a series of passes through successive dies of decreasing diameters; the cross-section reduction ratio is of the order of 0.9 for each pass, with the result that 20 passes are necessary in order to obtain the said delay fuse, the internal diameter of which is 1.26 mm.

This fuse has a rate of combustion of 3.4 mm/second. 20.4 cm of fuse are sufficient to induce a delay of 60 seconds in a pyrotechnic sequence.

EXAMPLES 2 TO 21

Several delay fuses according to the invention were manufactured by using the process described in Example 1.

The compositions used, the dimensions of the resulting fuses and the performances of the latter at ambient temperature are reported in the following table:

| Example No. | Composition in % by weight | | | | | Dimensions mm | | $R_c$[c] mm/second | $L_{60}$[d] cm | $R_1m$[e] seconds |
|---|---|---|---|---|---|---|---|---|---|---|
| | W 2μ | W 4μ | W 6μ | $BaCrO_4$ | $KClO_4$ | ed[a] | id[b] | | | |
| 2 | 34 | — | — | 56 | 10 | 2.0 | 1.26 | 4.0 | 24.0 | 250 |
| 3 | 34 | — | — | 56 | 10 | 2.5 | 1.58 | 3.95 | 23.7 | 253 |
| 4 | 34 | — | — | 56 | 10 | 3.0 | 1.89 | 4.0 | 24.0 | 250 |
| 5 | 32 | — | — | 58 | 10 | 2.5 | 1.58 | 3.42 | 20.5 | 292 |
| 6 | 32 | — | — | 58 | 10 | 3.0 | 1.89 | 3.39 | 20.3 | 295 |
| 7 | 28 | — | — | 62 | 10 | 2.0 | 1.26 | 2.10 | 12.6 | 476 |
| 8 | 28 | — | — | 62 | 10 | 2.5 | 1.58 | 1.98 | 11.9 | 505 |
| 9 | 28 | — | — | 62 | 10 | 3.0 | 1.89 | 1.92 | 11.5 | 521 |
| 10 | 28 | — | — | 60 | 10 | 2.5 | 1.58 | 2.6 | 15.6 | 385 |
| 11 | 30 | — | — | 60 | 10 | 1.8 | 1.13 | 2.44 | 14.6 | 410 |

-continued

| Example No. | Composition in % by weight W 2μ | W 4μ | W 6μ | $BaCrO_4$ | $KClO_4$ | Dimensions mm ed[a] | id[b] | $R_c$[c] mm/second | $L_{60}$[d] cm | $R_1m$[e] seconds |
|---|---|---|---|---|---|---|---|---|---|---|
| 12 | 30 | — | — | 60 | 10 | 2.0 | 1.26 | 2.44 | 14.6 | 410 |
| 13 | 30 | — | — | 60 | 10 | 2.5 | 1.58 | 2.44 | 14.6 | 410 |
| 14 | — | 44 | — | 45 | 11 | 2.0 | 1.26 | 4.0 | 24.0 | 250 |
| 15 | — | 35 | — | 55 | 10 | 2.0 | 1.26 | 2.4 | 14.4 | 417 |
| 16 | — | 31 | — | 60 | 9 | 2.0 | 1.26 | 1.8 | 10.8 | 556 |
| 17 | — | 28 | — | 62 | 10 | 3.0 | 1.26 | 1.5 | 9.0 | 667 |
| 18 | — | — | 35 | 55 | 10 | 2.0 | 1.26 | 1.87 | 11.2 | 535 |
| 19 | — | — | 35 | 55 | 10 | 2.5 | 1.58 | 1.87 | 11.2 | 535 |
| 20 | — | — | 35 | 55 | 10 | 3.0 | 1.89 | 1.88 | 11.3 | 532 |
| 21 | — | — | 30* | 60 | 10 | 2.5 | 1.58 | 1.89 | 11.4 | 526 |

*experiment carried out with tungsten having a particle size of 5.8 microns.
[a]ed: external diameter of the fuse
[b]id: internal diameter of the fuse or diameter of the core occupied by the composition
[c]$R_c$: rate of combustion
[d]$L_{60}$: length required to obtain a delay of 60 seconds
[e]$R_1m$: delay obtained with 1 meter of fuse.

The delay fuse according to Example 13 was tested in even greater depth. The density of the composition which it contained was 3.2 g/cm$^3$. During its operation, it released only 90 cm$^3$ of gas per linear meter (volume adjusted to normal conditions). Its rate of combustion is astonishingly stable because it changes from 2.44 mm/second at ambient temperature to 2.31 mm/second at −60° C. and to 2.5 mm/second at +70° C. At 110° C., the fuse still operates perfectly. It only self-ignites above about 510° C.

We claim:

1. Delay fuse having a rate of combustion which is less than or equal to 4 mm/second, which has an external diameter less than or equal to 3 mm, in which the ratio of the external diameter to the core occupied by the pyrotechnic composition is between 1.4 and 2.0, which contains a pyrotechnic composition consisting of 25 to 45% by weight of tungsten having a particle size of between 2 and 6 microns, from 45 to 65% by weight of barium chromate, and from 8 to 15% by weight of potassium perchlorate and which is free of silica.

2. The delay fuse according to claim 1, wherein the real density of the pyrotechnic composition is between 2.7 and 4.0 g/m$^3$.

3. Delay fuse according to claim 1, wherein the composition for filling the delay fuse only comprises from 28 to 35% by weight of tungsten having a particle size of between 2 and 4 microns, from 55 to 62% by weight of barium chromate and from 9 to 12% by weight of potassium chlorate.

4. Fuse according to claim 1, wherein the real density of the pyrotechnic composition is between 2.8 and 3.6 g/cm$^3$, preferably between 3.0 and 3.4 g/cm$^3$.

5. Fuse according to claim 1, characterised in that the envelope of the fuse consists of lead or a lead-based alloy.

6. Pyrotechnic sequence comprising a delay fuse according to claim 1.

* * * * *